United States Patent [19]

Emslander

[11] Patent Number: 4,733,786

[45] Date of Patent: Mar. 29, 1988

[54] CONTAINER AND INNERSEAL CAPABLE OF INDICATING HEAT TAMPERING

[75] Inventor: Jeffrey O. Emslander, Oakdale, Minn.

[73] Assignee: Minnesota Mining and Manufacturing Company, Saint Paul, Minn.

[21] Appl. No.: 928,803

[22] Filed: Nov. 7, 1986

[51] Int. Cl.[4] ..... B65D 51/00

[52] U.S. Cl. ..... 215/230; 215/232; 215/365; 428/315.5; 428/916

[58] Field of Search ..... 215/230, 232, 365; 206/459, 807; 116/216; 428/315.5, 913, 916

[56] References Cited

U.S. PATENT DOCUMENTS

| | | | |
|---|---|---|---|
| 2,131,774 | 10/1938 | Waring | 215/7 |
| 3,826,221 | 7/1974 | Ross | 215/230 X |
| 4,379,835 | 4/1983 | Lowrey et al. | 430/338 |
| 4,407,443 | 10/1983 | McCorkle | 383/5 |
| 4,457,430 | 7/1984 | Darling et al. | 206/459 |
| 4,459,046 | 7/1984 | Spirg | 116/216 X |
| 4,505,399 | 3/1985 | Weiner | 215/230 |
| 4,539,256 | 9/1985 | Shipman | 428/315.5 |
| 4,563,415 | 1/1986 | Brown et al. | 430/340 |
| 4,576,297 | 3/1986 | Larson | 215/250 |
| 4,579,240 | 4/1986 | Ou-Yang | 215/230 |

*Primary Examiner*—Donald F. Norton

*Attorney, Agent, or Firm*—Donald M. Sell; James A. Smith; David L. Weinstein

[57] ABSTRACT

Innerseal for bottles or other containers comprising a facing layer, an insulating layer adhered to one major surface of said facing layer, and a thermally sensitive layer adhered to said insulating layer. In a second embodiment, the innerseal comprises a facing layer and a thermally sensitive layer adhered to said facing layer. Upon application of a sufficient amount of heat to the thermally sensitive layer, said layer will change its appearance in such a way as to provide an indication of tampering by means of heat.

18 Claims, 6 Drawing Figures

CONTAINER AND INNERSEAL CAPABLE OF INDICATING HEAT TAMPERING

BACKGROUND OF THE INVENTION

1. Field of the Invention

This invention relates to innerseals for bottles or other containers which will provide a visual indication at the point of purchase, or before use, if the innerseal has been previously removed and reattached or if the innerseal has been applied to the container by one other than the packager.

2. Description of the Prior Art

This invention relates to an improvement in a container innerseal which fits beneath the container cap to afford the consumer an opportunity to readily determine whether or not the innerseal has been previously removed or tampered with since the container left the manufacturer or packaging company.

The need for prevention of removal of a container innerseal and replacing same without detection has existed for some time. In U.S. Pat. No. 2,131,774, there is disclosed a container closure having a metal shell having a screw threaded skirt and opening through the top thereof, a disk of rupturable material within said shell and exposed through said opening, a liner or gasket of compressible friction material within said shell, a plate having a recessed portion between said gasket and said disk, and a prong extending inwardly of the opening through the top of said shell and adapted, after the sealing of a container, to be forced downwardly to penetrate the portion of said disk across the recessed portion of said plate, whereby rotary movement of said shell to remove said closure will cause the tearing of said disk to an extent to prevent its re-use.

In U.S. Pat. No. 4,579,240, there is disclosed a tamper indicating cover member suitable for use on a wide variety of containers and comprising a cap having at least a portion of the top thereof being translucent, i.e., translucent or transparent, and an innerseal for sealing to the container after same has been filled. A deposit of adhesive or a heat sealable film adhere the cap, innerseal and container together in such a manner that relative rotation between the cap and the container ruptures the innerseal in a manner to be visible through the cap. The innerseal comprises a membrane of rupturable material adapted to be placed within the side walls and sealed to the inner surface of the top of the cap, with a second membrane of seal material adapted to be sealed to the upper surface of the neck of a container. The cap innerseal material may be punched from a web to form a disk shaped to be placed in a cap, utilizing a conventional machine for inserting cap liners into caps. After the container is filled, the cap and innerseal will be placed on the container. Suitable means, such as induction heating, can be utilized to seal the innerseal to the container about the opening thereof, and also to bond the rupturable disk to the cap. By this technique, the rupturable disk, cap and container will be adhered together in a manner such that the rupturable disk will tear as the cap is rotated relative to the container.

It has been found that certain kinds of innerseals can be removed from the mouth of the container by heating the innerseal to weaken the bond between the innerseal and container mouth and then carefully peeling the loosened innerseal away from the mouth of the container. The contents of the container can then be adulterated, and the innerseal resealed to the container mouth. Another method of tampering involves the steps of removing the innerseal from the mouth of a container having a relatively large diameter, cutting a disk out of the removed innerseal so that the disk is of a diameter suitable for covering the mouth of a container having a relatively small diameter, and heat sealing the altered disk to the mouth of the smaller container. If this method is conducted by a person of good manual dexterity, tampering will not be visible to the typical consumer.

Accordingly, it is desired by packagers that an innerseal be provided that will indicate (a) if heat has been employed to remove an innerseal from the mouth of a container and reseal same to the mouth of the container, or (b) if heat has been employed, other than by the packagers, to seal an altered innerseal to the mouth of a container.

SUMMARY OF THE INVENTION

The present invention provides a tamper-indicating innerseal, capable of detecting tampering by heat, suitable for use on a wide variety of containers, comprising, from bottom to top, (1) a facing layer, (2) an insulating layer adhered to said facing layer, (3) a thermally sensitive layer adhered to said insulating layer, said thermally sensitive layer capable of undergoing a change in either color or opacity upon application of a sufficient amount of heat thereto. Preferably, the facing layer is adhered to the insulating layer by means of an adhesive, e.g. a pressure-sensitive adhesive, and the insulating layer is adhered to the thermally sensitive layer by means of an adhesive, e.g. a pressure-sensitive adhesive. The insulating layer serves a triple purpose: (1) preventing the thermally sensitive layer from undergoing a change in color or opacity during the induction heat sealing process used by most packagers to seal the innerseal to the mouth of the container, (2) insulating the facing layer from heat applied during tampering, and (3) acting as a gasket for the container cap. In another embodiment, the insulating layer is omitted, and the innerseal consists of, from bottom to top, (1) a facing layer, and adhered to the facing layer (2) a thermally sensitive layer capable of undergoing a change in either color or opacity upon application of a sufficient amount of heat thereto. In the embodiment, the facing is sealed to the mouth of the container by some means other than heat sealing, such as, for example, a pressure-sensitive adhesive.

In the preferred embodiment, the thermally sensitive layer is opaque and becomes transparent upon application of heat, allowing a warning message printed on the insulating layer to be observed through the transparent layer. The preferred thermally sensitive layer has a microporous structure characterized by a multiplicity of spaced, randomly disposed, non-uniform shaped, equiaxed particles of thermoplastic polymer, adjacent particles throughout said microporous structure being separated from one another to provide the microporous structure with a network of interconnected micropores and being connected to each other by a plurality of fibrils consisting of said thermoplastic polymer. The application of a sufficient amount of heat to soften the opaque thermally sensitive layer collapses the microporous structure and renders the layer transparent.

The innerseal of this invention will indicate tampering involving the transfer of heat to the thermally sensitive layer.

BRIEF DESCRIPTION OF THE DRAWINGS

The invention will be further described with reference to the accompanying drawing wherein.

DETAILED DESCRIPTION

Figure 1:
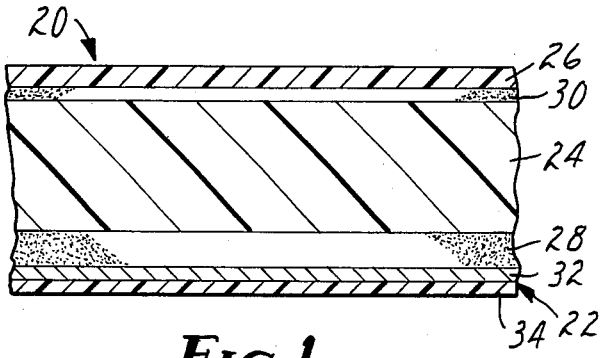
FIG. 1 is a cross sectional view of the preferred embodiment of this invention illustrating the construction of the web of innerseal material from which the cap innerseals are die cut.
Figure 2:
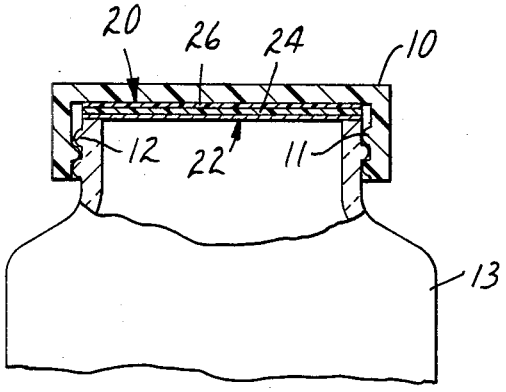
FIG. 2 is a vertical sectional view of a cap and innerseal constructed in accordance with the present invention sealed to a container, some parts of which are shown in elevatiion.

The present invention provides an improved innerseal which, when sealed to a container, will provide a tamper-indicating seal for the container. As illustrated in the attached drawings, where similar numerals on the various figures illustrate identical parts, a cap 10 is formed of a polymer or a metal, having a top and connecting side walls with internal threads 11 to mate with threads 12 provided on the outer surface about the neck and opening of container 13. Cap 10 can be a snap fitted cap to mate with a rib formed about the opening of the container, such as conventional child-proof caps having an arrow thereon which is rotated to match an arrow or location on the container, at which location the cap may be snapped off. The threaded cap is chosen for purposes of illustration.

An innerseal generally designated by the reference numeral 20 is typically placed inside the cap 10 by the cap manufacturer. Caps are supplied to the packager with the innerseal already in the cap.

Innerseal 20 comprises a facing layer 22 to one major surface of which is adhered an insulating layer 24. On the surface of the insulating layer 24 opposite the surface in contact with the facing layer 22 is adhered a layer of thermally sensitive material 26, that is capable of undergoing a change in color or change in opacity upon application of heat. Adhesion between the facing layor 22 and the insulating layer 24 and between the insulating layer 24 and the thermally sensitive layer 26 can be effected by any means that does not prematurely activate the thermally sensitive layer 26. The preferred mode of adhesion involves a first layer of adhesive 28 between the facing layer 22 and the insulating layer 24 and a second layer of adhesive 30 between insulating layer 24 and thermally sensitive layer 26. Preferably, adhesive layers 28 and 30 comprise pressure-sensitive adhesives. Alternatively layer 22 can be laminated to layer 24 and layer 24 can be laminated to layer 26, thereby dispensing with either layer 28 or 30, or both layers 28 and 30. The embodiment of innerseal 20 that includes insulating layer 24 can be sealed to the mouth of the container by means of induction heat sealing, as the insulating layer 24 shields the thermally sensitive layer 26 from the heat generated by the induction heat sealing process.

The facing layer 22 can be a conventional innerseal facing layer or any other type of layer which will bond the innerseal to the mouth of the container. Typically, the facing layer is a laminate, one layer of which is a metallic foil 32 and the other layer of which is a polymeric material 34. One purpose of the metallic foil is to generate heat when passed through an induction field to melt the polymeric material, thus allowing the polymeric material to bond the innerseal to the mouth of the container. The foil layer 32 is in face-to-face arrangement with the insulating layer 24. Materials that are suitable for preparing the foil layer 32 of the facing layer 22 include aluminum, tin, steel, and lead, with aluminum being preferred because of low expense and ease of availability. Materials that are suitable for preparing the polymeric material layer 34 of the facing layer 22 include heat sealable polymers, such as, for example, polyethylene, polypropylene, polystyrene, and heat sealable blends comprising polymers, such as, for example, a blend comprising various resins and waxes, such as that described in U.S. Ser. No. 722,822, filed Apr. 12, 1985, now U.S. Pat. No. 4,684,554 incorporated herein by reference. The thickness of the foil layer typically ranges from about one to about three mils, and the thickness of the polymeric material layer typically ranges from about one to about two mils.

The insulating layer 24 can be made of any material that will prevent the heat generated in the foil layer 32 of the facing layer 22 from prematurely activating the thermally sensitive layer 26. If, as stated previously, an induction heat sealing process is not used, the insulating layer would not be necessary. Materials that are suitable for the insulating layer include polymeric materials, e.g. foams, films, paper, and cork. Polymeric materials are preferred because of their handling characteristics. The insulating layer can be transparent or opaque. If the insulating layer is transparent, messages can be printed directly on the foil layer of the facing layer. If the insulating layer is opaque, messages can be printed on the insulating layer, or on the surface of the thermally sensitive layer facing the insulating layer. These messages, of course, indicate whether the innerseal has been subjected to tampering. Polymeric materials that are preferred for the insulating layer include polyethylene, polypropylene, and blends thereof. In the preferred embodiment, the thickness of insulating layer 24 typically ranges from about 10 mils to about 15 mils.

One function of the insulating layer 24 is to prevent the thermally sensitive layer from becoming activated during the induction sealing process. Another function of the insulating layer is to insulate the facing layer from heat applied during tampering. Because the facing layer is insulated, a large quantity of heat must be applied to the innerseal in order to delaminate the facing layer from the mouth of the container. This high level of heat is more likely to rapidly activate the thermally sensitive layer, thus rendering the innerseal construction more sensitive to heat tampering. In effect, the insulating layer causes the innerseal to be a one-way temperature indicator—when the innerseal is sealed with heat applied from the facing layer side of the insulating layer, as in the case of heat sealing by means of induction, the thermally sensitive layer will not be activated; when the innerseal is tampered with heat applied from the thermally sensitive layer side of the insulating layer, the thermally sensitive layer will be activated. A third function of the insulating layer is to act as a gasket to provide a tight seal between the cap and the mouth of the container.

Figure 3:
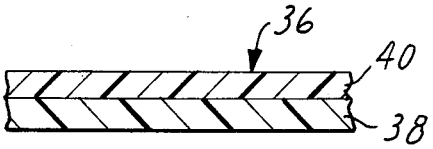
FIG. 3 is a cross-sectional view of a second embodiment of this invention illustrating the construction of the web of innerseal material from which the cap innerseals are die cut.

A second embodiment of the innerseal 36, illustrated in FIG. 3, consists of the facing layer 38 and thermally sensitive layer 40 only. Because of the omission of the insulating layer, the induction heat sealing process cannot be used to seal this innerseal to the mouth of the container. Accordingly, the facing layer must be adhered to the mouth of the container by means of an adhesive, such as, for example, a pressure-sensitive adhesive. In this embodiment, the facing layer 38 comprises a layer of polymeric material, e.g. film, foam, rather than a foil layer.

Figure 5:
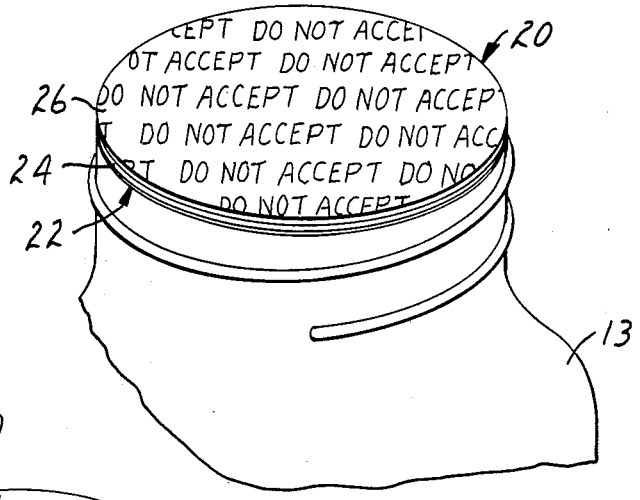
FIG. 5 is a perspective view of the innerseal of FIG. 1, greatly enlarged, after it has been tampered with by heat.
Figure 4:
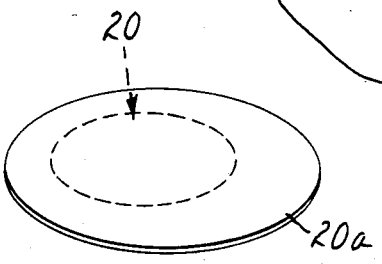
FIG. 4 is a perspective view of the innerseal of FIG. 1 before it has been subjected to tampering.

The thermally sensitive layer 26 is preferably made of a material described in U.S. Pat. No. 4,539,256, incorporated herein by reference. The sheet material described in the aforementioned patent is composed of randomly dispersed, equiaxed, irregularly shaped particles of thermoplastic polymer. Particles are spaced from one another to provide a network of micropores therebetween. Particles are connected to each other by fibrils which radiate from each particle to the adjacent particles. The particles of thermoplastic polymer in the structure refract and reflect light, causing it to appear opaque. Referring to FIG. 4, disk-shaped innerseal **20*a* represents an innerseal that was removed from a container having a relatively large mouth. The disk-shaped innerseal 20 that is circumscribed by the dotted line represents the portion of innerseal 20*a* that a tamperer would cut from innerseal 20*a* and subsequently attempt to seal to a container having a relatively small mouth. However, if the tamperer tries to seal innerseal 20 to an appropriate-sized container with heat sealing equipment other than an induction heat sealing apparatus, the internal structure of layer 26, upon exposure to a temperature in excess of the softening point of the thermoplastic material of which it is made, collapses and fuses, rendering it transparent. A warning message printed on the insulating layer 24 will then be visible through thermally sensitive layer 26 (see FIG. 5). Alternatively, the message can be printed on the facing layer 22 if the insulating layer 24 is transparent. As another alternative, the message can be printed on the surface of the thermally sensitive layer 26 that is facing the insulating layer 24**.

Figure 6:
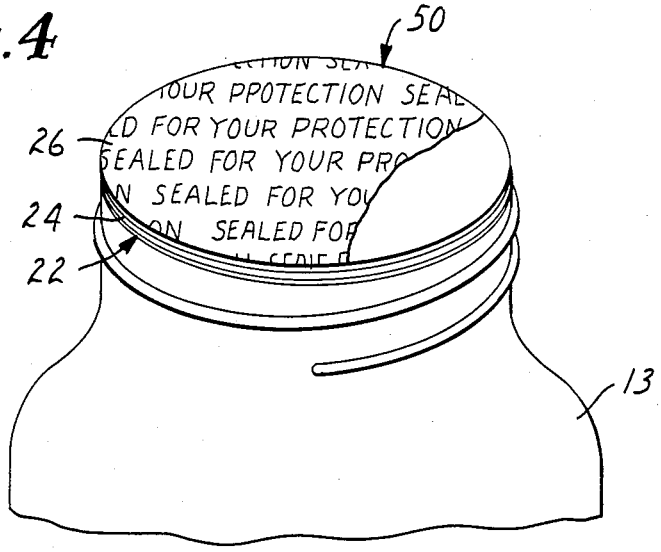
FIG. 6 is a diagrammatic perspective view of the innerseal of FIG. 1, greatly enlarged, after it has been tampered with by heat.

Rather than using a thermally sensitive layer that can be transformed from opaque to transparent, the thermally sensitive layer 26 can be made of a layer of transparent polymeric material bearing a thermally sensitive material, e.g. a composition comprising a leuco dye, thereon. Thermally sensitive leuco dye compositions are well-known and are described, for example, in U.S. Pat. Nos. 4,379,835 and 4,563,415, incorporated herein by reference. If this embodiment is employed, there are several ways of providing a message to the consumer to warn him or her if tampering by heat has occurred. For example, a message can be printed directly on the thermally sensitive layer 26 with a thermally sensitive leuco dye. Upon exposure to heat, the leuco dye will be converted to its colored form to reveal a warning message. As another example, as illustrated by innerseal 50 (see FIG. 6), a message can be printed on the insulating layer 24 so as to be visible through the transparent thermally sensitive layer 26. This message would indicate that the container has not been subject to tampering. The transparent thermally sensitive layer 26 would be coated with a layer comprising a transparent, thermally sensitive leuco dye. Upon exposure to heat, the dye would become opaque, blocking out the message on the insulating layer 24. A second message on the cap or label could be used to remind the consumer that absence of a written message means that the container has been subject to tampering. Other variations of leuco dyes, printed messages, etc. will become apparent to one of ordinary skill in the art. The thickness of layer 26 typically ranges from about one to about three mils.

The innerseal of this invention has several advantages. Any attempt to remove the innerseal by heat and replace it on the same container, or to remove the innerseal by heat, alter its size, and apply it to a smaller container, by means of heat sealing, would be revealed by the exposed message or obliterated message if the amount of heat applied were sufficient to activate the thermally sensitive layer. The change in appearance in the thermally sensitive layer is irreversible. The innerseal can be used with a screw cap or snap cap, and can be applied with conventional caplining and sealing equipment.

The following non-limiting examples will further serve to illustrate the present invention.

EXAMPLE 1

The following components were used to make an innerseal of the present invention:

A. The facing layer was a composite made of an aluminum foil sheet having a thickness of one mil bonded to a sheet of polyethylene having a thickness of one mil.

B. The insulating layer was a foam sheet made of a blend of 90% polyethylene and 10% polypropylene and having a thickness of 12 mil. The specific gravity of the foam sheet was 0.5.

C. The thermally sensitive layer was a sheet of film made in accordance with U.S. Pat. No. 4,539,296 and having a thickness of 2 mil.

One surface of the insulating layer was bonded to the aluminum foil surface of the facing layer by means of a conventional thermosetting adhesive. The other surface of the insulating layer was bonded to a surface of the opaque layer by means of a conventional thermosetting adhesive. A disk having a diameter of 38 mm was then cut from the resulting composite sheet. This disk was the innerseal. The innerseal was placed in a cap, the thermally sensitive layer in face-to-face contact with the top of the cap. The cap, which contained the innerseal disk, was placed on the container.

The capped container was passed through a conventional induction heating field, the aluminum foil layer heated up instantaneously, and the heat sealable layer was melted and bonded to the mouth of the container.

If one desired to remove the innerseal by heating, such as, for example, with an iron, the heat from the iron would cause the thermally sensitive layer to become transparent. If one desired to apply an innerseal of this invention by means of heat supplied from a source adjacent to the thermally sensitive layer, the heat from this source would cause the thermally sensitive layer to be activated.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An innerseal, capable of detecting tampering by means of heat, comprising:
(a) a facing layer,
(b) an insulating layer adhered to one major surface of said facing layer, and
(c) a thermally sensitive layer adhered to the surface of said insulating layer that is not adhered to said facing layer, said thermally sensitive layer capable of changing its appearance upon application of a sufficient amount of heat thereto.

2. The innerseal of claim 1 wherein said facing layer comprises a first layer made of a metallic foil and a second layer made of a polymeric material.

3. The innerseal of claim 2 wherein said polymeric material is a heat sealable material.

4. The innerseal of claim 2 wherein said insulating layer is in face-to-face contact with said metallic foil.

5. The innerseal of claim 1 wherein said insulating layer is transparent.

6. The innerseal of claim 5 wherein said facing layer has an image printed thereon, said image capable of being seen only when a sufficient amount of heat is applied to said thermally sensitive layer.

7. The innerseal of claim 1 wherein said insulating layer is opaque.

8. The innerseal of claim 7 wherein said insulating layer has an image printed thereon, said image capable of being seen only when a sufficient amount of heat is applied to said thermally sensitive layer.

9. The innerseal of claim 1 wherein said thermally sensitive layer has an image printed thereon, said image capable of being seen only when a sufficient amount of heat is applied to said thermally sensitive layer.

10. The innerseal of claim 1 wherein said thermally sensitive layer is formed of randomly dispersed, equiaxed, irregularly shaped particles of thermoplastic polymer, said particles being spaced from one another to provide a network of micropores therebetween, said particles being connected to each other by fibrils which radiate from each particle to the adjacent particles.

11. The innerseal of claim 1 wherein said thermally sensitive layer comprises a transparent polymeric film wherein at least a portion thereof has a thermally imageable material coated thereon.

12. An innerseal, capable of detecting tampering by means of heat, comprising:
(a) a facing layer, and
(b) a thermally sensitive layer adhered to said facing layer, said thermally sensitive layer capable of changing its appearance upon application of a sufficient amount of heat thereto wherein said thermally sensitive layer is formed of randomly dispersed, equiaxed, irregularly shaped particles of thermoplastic polymer, said particles being spaced from one another to provide a network of micropores therebetween, said particles being connected to each other by fibrils which radiate from each particle to the adjacent particles.

13. The innerseal of claim 12 wherein said facing layer comprises a layer of metallic foil or polymeric material bearing an adhesive on at least one major surface thereof.

14. The innerseal of claim 12 wherein said facing layer has an image printed thereon, said image capable of being seen only when a sufficient amount of heat is applied to said thermally sensitive layer.

15. The innerseal of claim 12 wherein said thermally sensitive layer has an image printed thereon, said image capable of being seen only when a sufficient amount of heat is applied to said thermally sensitive layer.

16. The innerseal of claim 12 wherein said thermally sensitive layer comprises a transparent polymeric film wherein at least a portion thereof has a thermally imageable material coated thereon.

17. A container having a tamper-indicating innerseal comprising
(a) a facing layer,
(b) an insulating layer adhered to one major surface of said facing layer, and
(c) a thermally sensitive layer adhered to the surface of said insulating layer that is not adhered to said facing layer, said thermally sensitive layer capable of changing its appearance upon application of a sufficient amount of heat thereto.

18. A container having a tamper-indicating innerseal comprising:
(a) a facing layer, and
(b) a thermally sensitive layer adhered to said facing layer, said thermally sensitive layer capable of changing its appearance upon application of a sufficient amount of heat thereto wherein said thermally sensitive layer is formed of randomly dispersed, equiaxed, irregularly shaped particles of thermoplastic polymer, said particles being spaced from one another to provide a network of micropores therebetween, said particles being connected to each other by fibrils which radiate from each particle to the adjacent particles.

* * * * *

UNITED STATES PATENT AND TRADEMARK OFFICE

CERTIFICATE OF CORRECTION

PATENT NO. : 4,733,786

DATED : March 29, 1988

INVENTOR(S) : Jeffrey O. Emslander

It is certified that error appears in the above-identified patent and that said Letters Patent is hereby corrected as shown below:

Col. 3, line 53, "layor" should be --layer--

Signed and Sealed this

Second Day of August, 1988

*Attest:*

DONALD J. QUIGG

*Attesting Officer*

*Commissioner of Patents and Trademarks*